US005882287A

United States Patent [19]

Kuckhermann

[11] Patent Number: 5,882,287

[45] Date of Patent: Mar. 16, 1999

[54] DEVICE FOR MANUFACTURING A MULTILAYERED TUBE FOR THE MANUFACTURE OF PAPER BAGS

[75] Inventor: Gustav Kuckhermann, Lengerich, Germany

[73] Assignee: Windmoller & Holscher, Lengerich/Westf., Germany

[21] Appl. No.: 374,154

[22] Filed: Jan. 18, 1995

[30] Foreign Application Priority Data

Jan. 21, 1994 [DE] Germany ..... 44 01 723.5

[51] Int. Cl.[6] ..... B31C 13/00

[52] U.S. Cl. ..... 493/297; 493/367; 493/289

[58] Field of Search ..... 493/220, 223, 493/224, 297, 288, 346, 381, 393, 366, 367, 365, 289; 225/100; 156/217, 218, 252, 253, 257, 461, 465, 466, 514, 198, 203, 324, 290, 291, 548, 513; 83/343, 346, 347, 303, 331, 332, 333, 677, 663, 698.51, 698.61, 304, 305

[56] References Cited

U.S. PATENT DOCUMENTS

| | | | |
|---|---|---|---|
| 1,203,302 | 10/1916 | Bickett | 493/381 |
| 1,848,709 | 3/1932 | Gurwick | 493/220 |
| 2,013,086 | 9/1935 | Baker . | |
| 2,581,801 | 1/1952 | Lienart | 493/288 |
| 3,810,809 | 5/1974 | Herd et al. | 156/513 |
| 4,240,313 | 12/1980 | Gillespie | 83/698.61 |
| 5,367,936 | 11/1994 | Held et al. | 83/698.51 |
| 5,394,779 | 3/1995 | Meeks | 83/332 |

*Primary Examiner*—Joseph J. Hail, III
*Assistant Examiner*—Darren Ark
*Attorney, Agent, or Firm*—Keck, Mahin & Cate

[57] ABSTRACT

A device for manufacturing a multilayered tube formed of paper webs that are provided with transverse perforations at identical distances, wherein sections of the tube are torn off in order to manufacture paper bags, includes at least one perforating knife that is arranged in the machine frame and fastened to a rotating shaft. The perforating knife provides the paper webs with transverse perforations, and the radial distance between the perforating knife and the shaft may be altered so as to adjust the format of the bags. In addition, the device includes transverse gluing cylinders that are arranged in the machine frame, which are provided with transverse gluing bars and which cooperate with devices for applying glue. Also included is a longitudinal gluing roller that applies glue which forms a longitudinal adhesive seam onto the edges of the paper webs which are laterally offset with respect to one another and guided together via guide rollers before the paper webs are folded into a tube. In order to make it possible to reequip the device in a simple and rapid fashion such that tube sections of different lengths may be manufactured, four carriers for perforating knives that may be selectively fastened onto the carriers are arranged on the shaft at identical angular distances. The carriers are provided with devices for adjusting their radial distance from each shaft.

7 Claims, 2 Drawing Sheets

1
2
3
4
5
6
7
8
8'
9
9'
10
10'
11
12
13
14
16
17
18
19
20
21
24
25
30
36

1
2
3
4
5
6
7
8
8'
9
9'
10
10'
11
12
13
14
16
17
18
19
20
21
24
25
30
36
40

DEVICE FOR MANUFACTURING A MULTILAYERED TUBE FOR THE MANUFACTURE OF PAPER BAGS

FIELD OF THE INVENTION

The invention pertains to a device for manufacturing a multilayered tube of paper webs that are provided with transverse perforations at identical distances, wherein sections of the tube are torn off in order to manufacture paper bags, with at least one perforating knife that is arranged in the machine frame and fastened to a rotating shaft. The perforating knife provides the paper webs with transverse perforations and the radial distance between the perforating knife and the shaft may be altered so as to adjust the format of the bags. Transverse gluing cylinders are arranged in the machine frame and are provided with transverse gluing bars for cooperating with devices for applying the glue. A longitudinal gluing roller applies glue for forming a longitudinal adhesive seam onto edges of the paper webs that are laterally offset with respect to one another and guided together via guide rollers before the paper webs are folded into a tube.

BACKGROUND OF THE INVENTION

Paper bags, e.g., for packaging cement or other powdered or granular materials of high solidity, are manufactured of multilayered tube sections, the individual layers of which are glued together at their edges during the formation of the tube, wherein the individual layers lie on top of one another at the ends of the paper bags such that their cut edges are aligned (straight cut) or preferably only overlap one another in a partially staggered formation, so that the layers are also glued together individually during the formation of the base of the bag.

Rational machine requirements make it necessary that the equipment be able to manufacture tube sections of different formats with a staggered arrangement of the individual paper layers. In order to realize this desired variability of the format in so-called "tube machines," the distances between the transverse perforations that determine the length of the tube sections must be altered in the individual paper layers, and it must also be possible to correspondingly adapt the distances between the transversely extending transverse gluing strips.

Although it is inconsequential if certain differences exist between the circumferential speed of the transverse gluing bars and the moving speed of the paper web such that certain smearing of the applied glue occurs due to the relative speed, such differences between the circumferential speed of the perforating knives and the moving speed of the paper webs cannot be accepted because these relative speeds may lead to tearing of the transverse perforations and consequently a separation of the paper web.

In order to make it possible to provide paper webs in tube machines with transverse perforations at different distances, it is known to drive the rotating perforating knives via transmissions with varying velocity ratio in such a way that the paper web is advanced at a speed that differs from the circumferential speed of the perforating knife within the region in which the perforating knife is not in contact with the paper web, while the circumferential speed of the perforating knife essentially is identical to the moving speed of the paper web at the time at which the perforating knife comes in contact with the paper web. Such transmissions with varying velocity ratio include slider crank gears which, due to their nonuniformity, are exposed to rapid accelerations and decelerations during their revolutions, so that, due to the resulting inertial forces, the machine operates with less power in order to maintain the inertial forces created within permissible limits.

U.S. Pat. No. 2,013,086 discloses a tube machine of the initially mentioned type in which the perforating knives that produce the transverse perforations are fastened onto arms that may be adjusted relative to the shafts carrying the perforation knives in the radial direction. These radially adjustable perforating knives may be continuously driven at the same circumferential speed as the moving speed of the paper webs by correspondingly altering the axial distances between the shafts carrying the perforating knives, so that no nonuniformities that could limit the operating speed of the tube machine due to the inertial forces are present in the drive unit. However, the adjustment of different formats in this known machine is limited due to the fact that, when reducing the distance between the transverse perforations, the arms carrying the perforating knives can only be adjusted radially inward to such an extent that their outer ends that protrude beyond the shafts do not come into contact with the paper web and damage it. Consequently, this known tube machine only allows a variability in the format to such an extent that the largest lengths are approximately twice as large as the smallest lengths because otherwise the ends of the arms that are equipped with the perforating tool would come into contact with the passing paper webs if the distances between the perforations would be reduced additionally. Consequently, this known tube machine does not fulfill today's demands for a variable format because it is required to manufacture tube sections, the smallest lengths of which approximately correspond to one-sixth to one-eighth of the largest length.

SUMMARY OF THE INVENTION

The invention is based on the objective of creating a tube machine of the initially mentioned type which makes it possible to manufacture tube sections with lengths that vary within a broad range with high efficiency while only requiring a simple reequipping process.

According to the invention, this objective is attained with a device of the aforementioned type which is characterized by the fact that four carriers for perforating knives that may be selectively fastened to said carriers are arranged at identical angular distances, wherein the carriers are provided with devices for adjusting their radial distance from each shaft. In a tube machine according to the invention, the greatest distance between the transverse perforations in the paper webs can be simply obtained by extending the carriers to their greatest radial distance from the shaft carrying the carrier and only fastening a perforating knife to one carrier. If it is intended to adjust to the smallest possible distance between the transverse perforations, the four carriers are adjusted inwardly to their smallest radial distance from the shaft, and the perforating knives are attached to all four carriers. When adjusting the carriers to an average distance, perforating knives may be attached to opposite carriers. All other formats between the largest and the smallest adjustable distance between the transverse perforations may be obtained by extending and retracting the carriers correspondingly and/or fastening one, two or four perforating knives to the carriers. Since the tube machine according to the invention does not require a transmission with varying velocity ratio and the moving speed of the paper webs may be adapted to the respective circumferential speed of the perforating knives, the device according to the invention may be operated with high efficiency such that a variability in the format within broad limitations is attained.

The previous description pertains to one embodiment of the invention in which the layers that are formed by the paper webs are shaped into a tube before the transverse perforations are produced since sections that have cut edges that lie flush on top of one another at the ends of the sections are torn off the tube. In order to make it possible to tear sections with straight cuts off a multilayered tube, the perforations of the individual layers must exactly lie on top of one another, i.e., only one perforating knife which perforates all layers that were shaped into a tube is provided.

The invention may be utilized in a particularly advantageous fashion for realizing the manufacture of so-called staggered bags in which the individual layers of the multilayered tube sections additionally overlap one another partially in the longitudinal direction. According to one preferred embodiment of the invention, it is proposed that at least one perforating knife that is fastened onto a rotating shaft be provided in the machine frame for each of the paper webs that move over the guide rollers separately from one another, wherein the perforating knife provides the paper webs with transverse perforations that are offset with respect to one another in the longitudinal direction, and that four carriers for perforating knives that can be selectively fastened to the carriers be arranged on the shafts at identical angular distances, wherein the carriers are provided with devices for adjusting their radial distance from each shaft.

Although a certain amount of smearing of the transverse gluing strips applied must be accepted in such tube machines, the smearing caused by the relative speed between the paper webs and the transverse gluing bars cannot exceed a permissible value. According to one additional embodiment of the invention, it is proposed that the transverse gluing cylinders be provided with four receptacles for the transverse gluing bars at identical angular distances, wherein the same number of receptacles as the number of perforating knives are provided. Consequently, an appropriate selection of the diameter of the transverse gluing cylinder makes it possible to insure that a number of transverse gluing bars that corresponds to the number of perforating knives utilized is provided, i.e., smearing of the transversely -extending gluing strips occurs only to an acceptable extent without having to carry out a complicated alteration of the diameter of the transverse gluing cylinder. When reequipping the tube machine to a different format, the transverse gluing cylinders simply need to be provided with a number of transverse gluing bars that corresponds to the number of perforating knives. Thus, this process may be realized in a particularly simple and rapid fashion.

It is practical if the distance between opposite receptacles for the transverse gluing cylinders corresponds to the average adjustable distance between opposite perforating knife carriers.

In order to make it possible to process the tube sections that were torn off the tube into bags in an undisturbed fashion by attaching the base parts, the layers that are arranged in a staggered fashion must be free of glue at the ends of the tube sections. According to one additional embodiment of the invention, it is proposed that the longitudinal gluing roller of constant diameter be provided with four recesses over its perimeter that may be closed selectively, wherein the recesses prevent the application of glue onto the edges of the paper web that are provided with the transverse perforations. Regarding this longitudinal gluing roller, a certain relative speed between its perimeter and the moving speed of the web may be accepted as long as it is insured that the recesses bridge the respective edges of the paper web that were provided with transverse perforations.

BRIEF DESCRIPTION OF THE DRAWINGS

Embodiments of the invention are described in detail below with reference to the figures. The figures show.

DETAILED DESCRIPTION OF THE PREFERRED EMBODIMENTS

Figure 1:
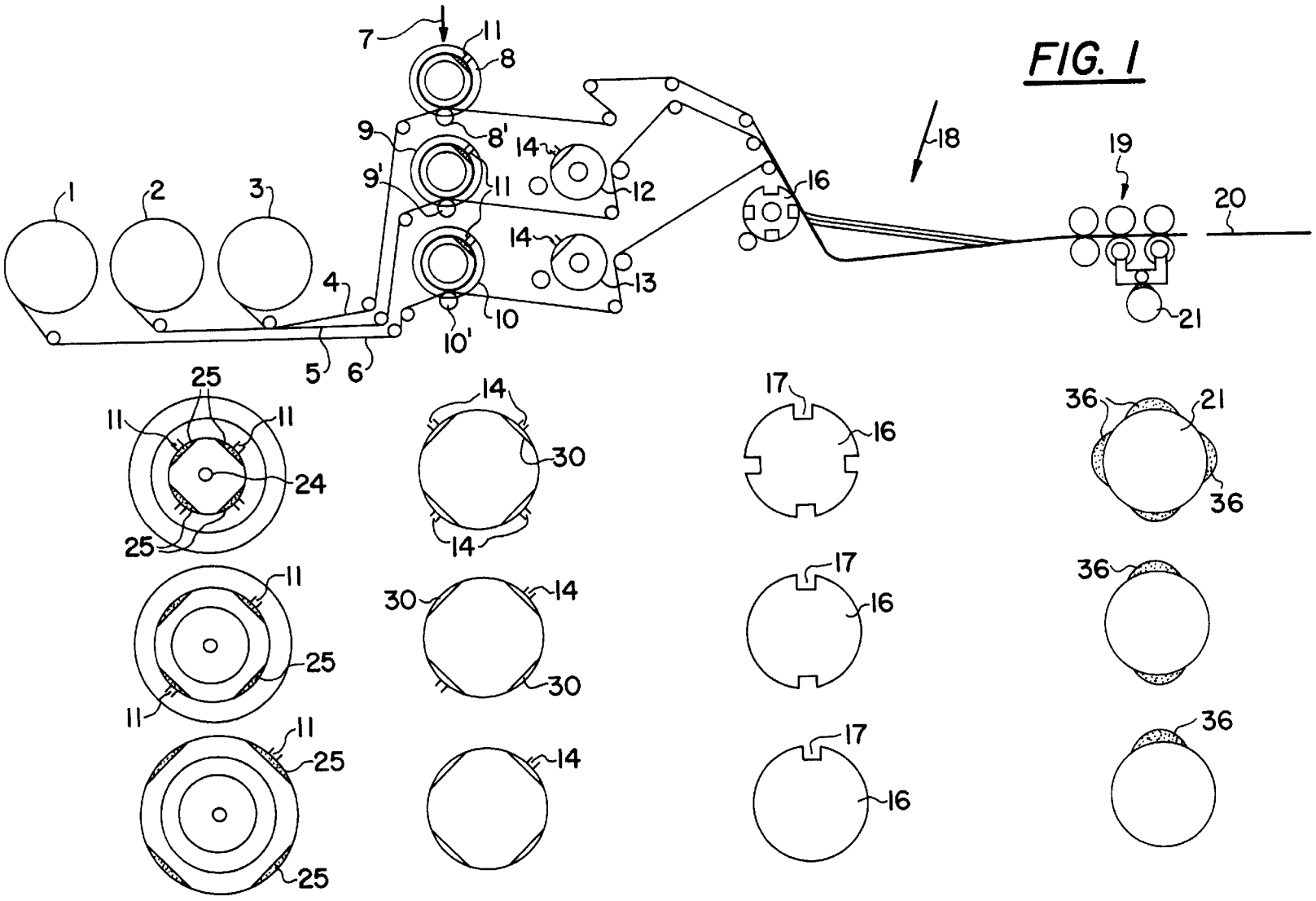
FIG. 1: a schematic side view of a tube machine for manufacturing staggered bags.

The tube machine illustrated in FIG. 1 includes, for example, three unwinding frames that are not illustrated in the figures, and in which paper reels 1, 2, 3 that are arranged behind one another are held, wherein flat paper webs 4, 5, 6 are unwound from reels 1, 2, 3 via guide rollers and unwinding and/or pay-out devices.

Three perforating cylinders 8, 9, 10 that are provided with separate drive units are arranged in a machine frame that is not illustrated in the figures. The perforating knives 11 of these perforating cylinders cooperate with opposite knife cylinders 8', 9', 10'.

Two transverse gluing cylinders 12, 13 that are provided with separate drive units and the transverse gluing bars of which provide the paper webs 5 and 6 with transversely extending tracks of glue are arranged in the machine frame behind the transverse perforating cylinders 8 through 10 viewed in the moving direction of the webs that are guided at an equal distance from one another. The transverse gluing bars 14 of the transverse gluing cylinders 12, 13 receive their glue from glue application rollers in conventional fashion.

The paper webs 4, 5, 6 are guided together in order to be combined into a multilayered web behind the transverse gluing cylinders 12, 13. One edge of the web at which the individual webs lie laterally offset to one another is provided with a bead of glue that subsequently forms the longitudinal adhesive seam via a longitudinal gluing roller 16, wherein the gluing roller 16 is provided with recesses 17 which insure that no glue is applied to the edges of the multilayered paper web which are provided with transverse perforations. The longitudinal gluing segment(s) of the longitudinal gluing roller that lie(s) between the recesses 17 receive(s) glue from a glue application roller in conventional fashion.

The multilayered paper web which was prepared in the previously described fashion is subsequently folded into a tube in a tube forming station 18, wherein the respective edges of the individual layers that do not overlap are glued together. Individual tube sections 20 are torn off the paper tube in a tearing station 19. The tearing station is provided with a conventional tearing mechanism that consists of two rollers that are driven at a different circumferential speed, wherein the front roller forms a holding roller and the rear roller forms a tearing roller. Counter rollers that are arranged in a movable carrier are pressed against the holding roller and the tearing roller via a roller 21 that is provided with cams, at the timing in which the individual sections 20 are torn off.

The left column of the figure shows schematic perforating cylinders at differently adjusted positions.

Each of the perforating cylinders 8 through 10 has a central shaft 24 on which four tool carriers 25 are held. The tool carriers are provided with adjusting devices that allow a radial extension for the tool carriers toward the shaft 24. The devices for radially extending the tool carriers 25 can, for example, consist of two connecting rods that are linked to the tool carriers 25, wherein the other ends of the connecting rods are connected with sliding elements in an articulated fashion. The sliding elements are arranged on the shafts 24 in such a way that they may be moved axially in opposite directions by identical distances via adjusting devices.

The illustrations in the left column show that one to four perforating knives 11 can be fastened onto the tool carriers 25.

In the three illustrations in the left column, the tool carriers are illustrated in positions in which they are extended different distances in the radial direction. The tool carriers are extended the farthest in the illustration on the bottom, wherein one tool carrier 25 is equipped with a perforating knife 11, so that the largest distances between the transverse perforations are attained in this position.

In the central illustration, the tool carriers 25 are adjusted to an average distance, wherein two opposing tool carriers are equipped with perforating knives 11.

The illustration on top of the left column shows the innermost position of the carriers 25, all of which are equipped with perforating knives 11, so that the smallest distance between the transverse perforations is attained.

The second column of this figure shows the transverse gluing cylinders 12, 13, the receptacles 30 of which are fastened such that the distance between said receptacles cannot be altered. The individual receptacles 30 are provided with a number of transverse gluing bars 14 that corresponds to the number of perforating knives 11.

The third column of this figure shows the longitudinal gluing roller 16 which is provided with recesses 17 in accordance with the respective number of perforating knives 11 and transverse gluing bars 14. These recesses bridge the application of the longitudinally extending track of glue within the respective transversely perforated regions.

The timing of the tearing tool also must be adapted in accordance with the adjustable distance between the transverse perforations. For this purpose, the cam roller 21 is provided with one to four cams 36 that press the movable rollers against the holding and tearing roller of the tearing mechanism with an adjustable timing.

Figure 2:
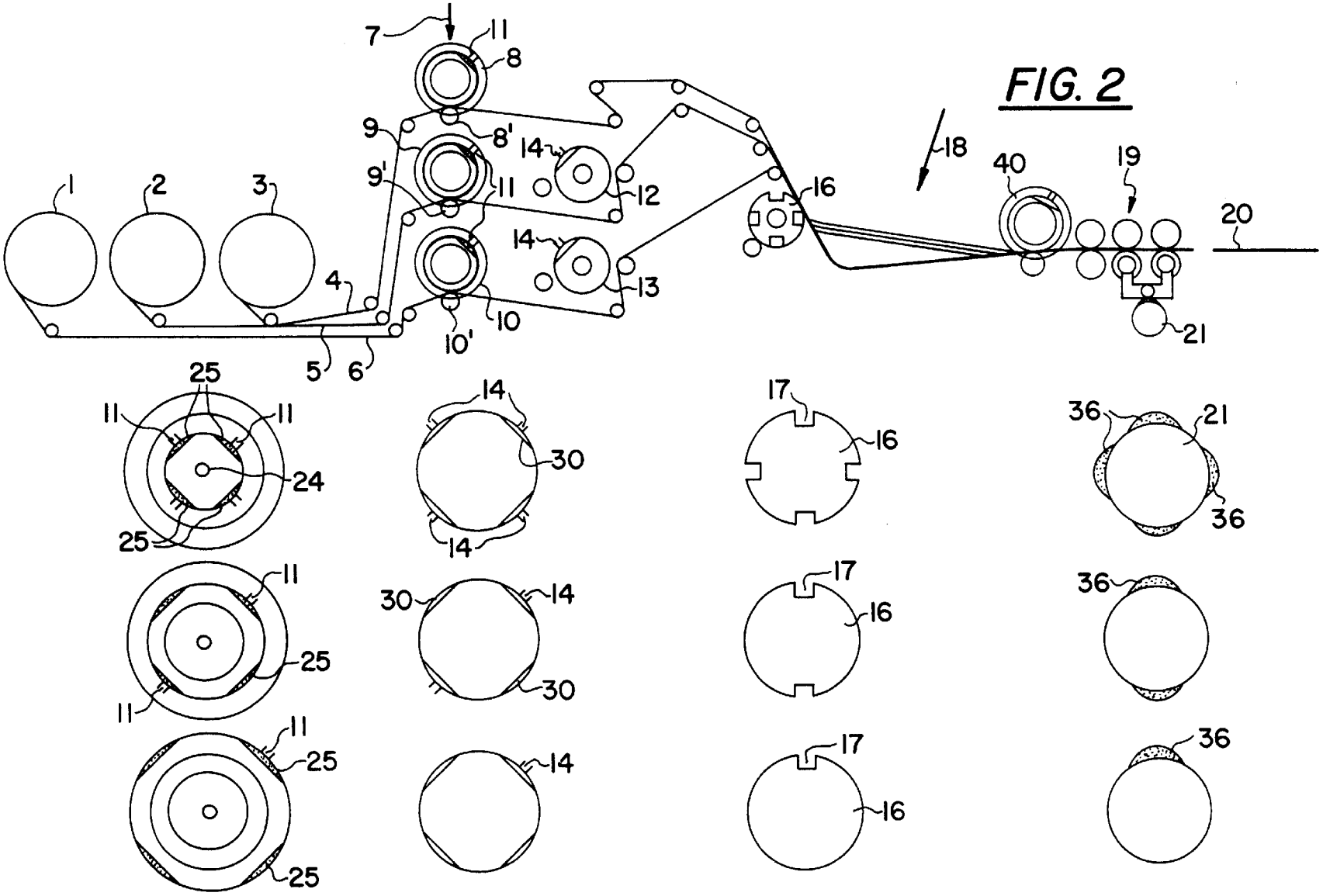
FIG. 2: a schematic side view of a tube machine which allows the selective manufacture of staggered bags as well as multilayered tube sections with straight cuts.

FIG. 2 shows a variation of the tube machine according to FIG. 1 in which a continuously perforating cylinder 40 is arranged flat in front of the tearing station 19, wherein the perforating knives of the perforating cylinder cooperate with an opposite cylinder 41. The perforating cylinder 40 has the same design and the same construction as the perforating cylinders 8, 9, 10, such that a repeated description is unnecessary.

If it is intended to only manufacture tube sections with so-called straight cuts, the tube machine is only provided with the perforating cylinder 40. Consequently, the perforating cylinders 8, 9, 10 may be omitted in a tube machine of this type. However, if it is intended to design the tube machine in such a way that tube sections with staggered cuts as well as straight cuts may be manufactured selectively, said machine is equipped with the perforating cylinders 8, 9, 10, as well as the perforating cylinder 40 which may be selectively moved into the operating position.

What is claimed is:

1. A device for manufacturing a multilayered tube formed of paper webs that are provided with transverse perforations at identical distances, wherein sections of said tube are torn off for manufacturing paper bags; wherein said device comprises:

at least one perforating knife arranged in a machine frame and fastened onto a rotating shaft, wherein said at least one perforating knife provides the paper webs with transverse perforations and a means is provided for adjusting a radial distance between the at least one perforating knife and the shaft is so as to adjust a format of the bags;

transverse gluing cylinders arranged in the machine frame, wherein said cylinders are provided with transverse gluing bars and said cylinders cooperate with devices for applying glue; and a longitudinal gluing roller that applies the glue which forms a longitudinal adhesive seam on edges of the paper webs that are laterally offset from one another and guided together via guide rollers before said paper webs are folded into a tube; and a plurality of carriers (25) are provided for the at least one perforating knife (11) that is selectively fastened onto said carriers, said carriers being arranged on said rotating shaft (24) at identical angular distances and at an adjustable radial distance thereof from each shaft (24);

wherein the transverse gluing cylinders (12,13) are provided with a plurality of receptacles (30) for the transverse gluing bars (14) at identical angular distances, wherein the number of transverse gluing bars corresponds to the number of perforating knives (11);

wherein a distance between opposite receptacles (30) of the transverse gluing cylinders (12,13) corresponds to an average adjustable distance between opposite carriers (25) for the at least one perforating knife (11) throughout the range of radial adjustment thereof.

2. A device according to claim 1, wherein each of the paper webs (4,5,6) that move over guide rollers separately from one another is provided in the machine frame with said at least one perforating knife (11) that is fastened to said carriers on said rotating shaft (24), wherein said at least one perforating knife provides the paper webs (4,5,6) with said transverse perforations that lie offset with respect to one another in the longitudinal direction, and four carriers (25) for perforating knives (11) that may be selectively fastened to said carriers are arranged on the shafts (24) at identical angular distances, wherein said carriers are provided with devices for adjusting a radial distance thereof from each shaft (24).

3. A device according to claim 1, wherein said longitudinal gluing roller (16) has a constant diameter and a plurality of recesses (17) are provided over a circumference of said longitudinal gluing roller wherein said plurality of recesses prevent application of glue onto edges of the paper webs that are provided with said transverse perforations.

4. A device according to claim 3, wherein the longitudinal gluing roller comprises four recesses.

5. A device according to claim 3, wherein the plurality of recesses are selectively closable.

6. A device according to claim 1, comprising four carriers for said perforating knives.

7. A device according to claim 1, comprising four receptacles for said transverse gluing bars.

* * * * *